United States Patent [19]

Kautzky

[11] 4,188,044

[45] Feb. 12, 1980

[54] CONNECTING ARRANGEMENT FOR THE DETACHABLE MOUNTING OF A BINDING ON SKIS

[76] Inventor: Norbert Kautzky, Schöffelgasse 26-28, A-1180, Vienna, Austria

[21] Appl. No.: 878,761

[22] Filed: Feb. 17, 1978

[30] Foreign Application Priority Data

Feb. 18, 1977 [AT] Austria ..... 1095/77

[51] Int. Cl.[2] ..... A63C 9/00

[52] U.S. Cl. ..... 280/611

[58] Field of Search ..... 280/611, 615, 633, 617, 280/607; 9/310 AA

[56] References Cited

U.S. PATENT DOCUMENTS

| | | | |
|---|---|---|---|
| 3,219,359 | 11/1965 | Schneider | 280/633 |
| 3,514,119 | 5/1970 | Sutherland | 280/617 |
| 3,675,938 | 7/1972 | Sigl | 280/636 |
| 3,977,688 | 8/1976 | Imagawa | 280/607 X |

FOREIGN PATENT DOCUMENTS

| | | | |
|---|---|---|---|
| 270466 | 4/1969 | Austria | 280/611 |
| 810088 | 3/1937 | France | 280/615 |

*Primary Examiner*—Joseph F. Peters, Jr.
*Assistant Examiner*—Milton L. Smith

[57] ABSTRACT

A connecting arrangement for detachably mounting a binding member consisting of a front binding device and a rear binding device on a ski member comprises connecting studs affixed to one of the members and the other member defining bores arranged to receive the connecting studs whereby the studs may be plugged into the bores. The studs extend obliquely to the upper surface of the ski member and enclose therewith an acute angle substantially less than 90° in planes extending perpendicularly to the upper ski member surface and parallel to a longitudinal center line of the ski member when the binding member is mounted thereon. The studs associated with the front binding device extend in one direction and the studs associated with the rear binding device extend in another direction, the studs associated with the front binding device being arranged substantially symmetrically with respect to the studs associated with the rear binding device in relation to a plane of symmetry extending perpendicularly and transversely to the upper ski member surface between the front and rear binding devices.

21 Claims, 14 Drawing Figures

Figure 7:
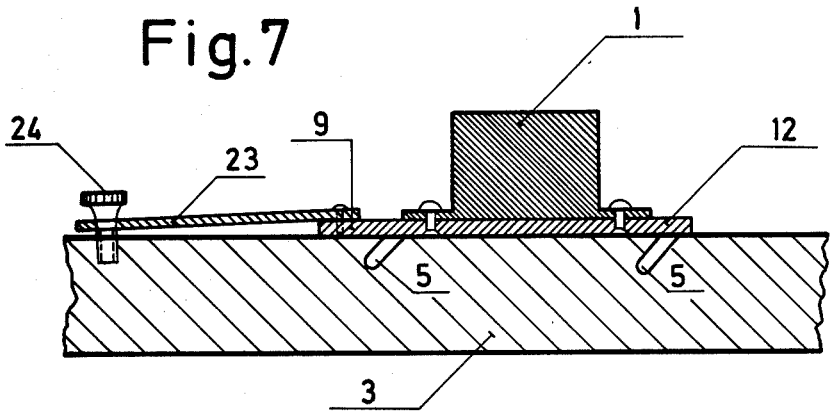

Fig. 1
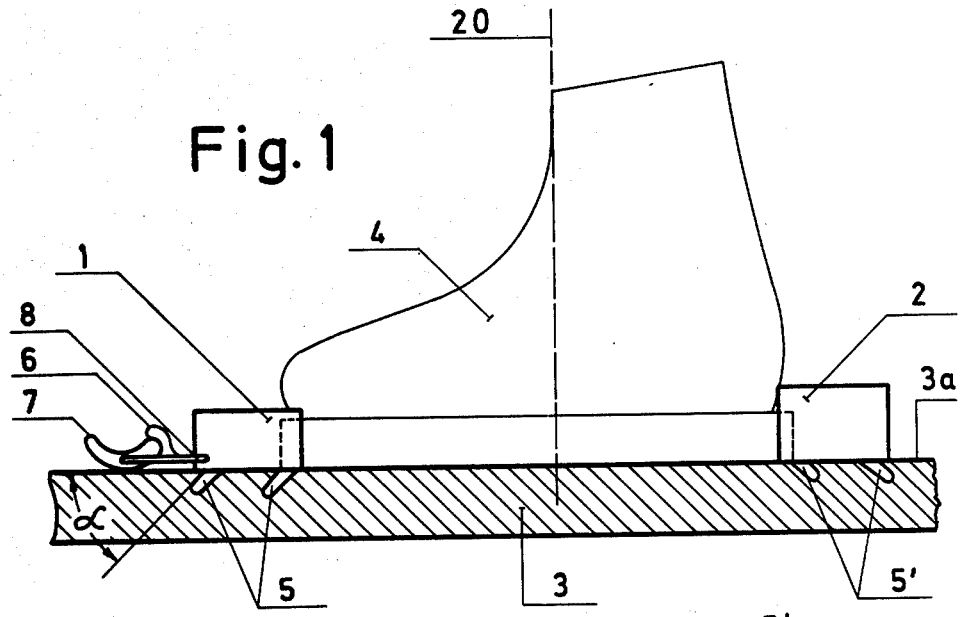
Fig.2
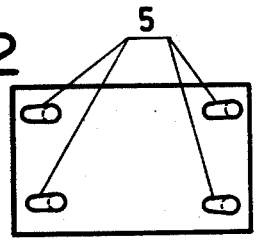
Fig.2b
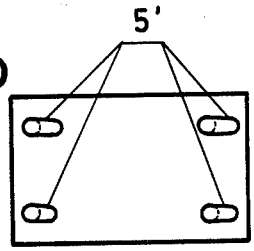
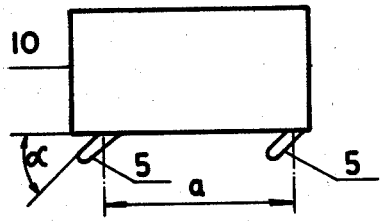
Fig.2a
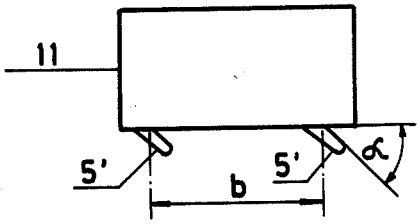
Fig.2c
Fig. 3
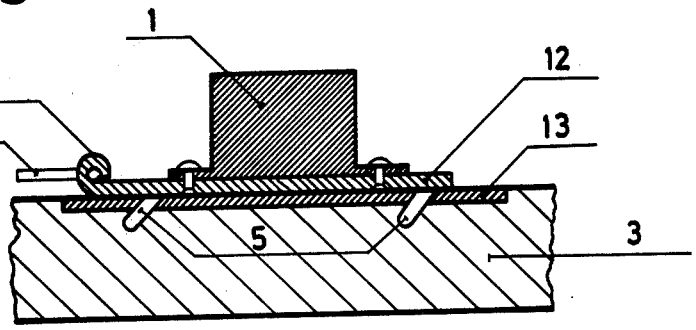

Fig. 4
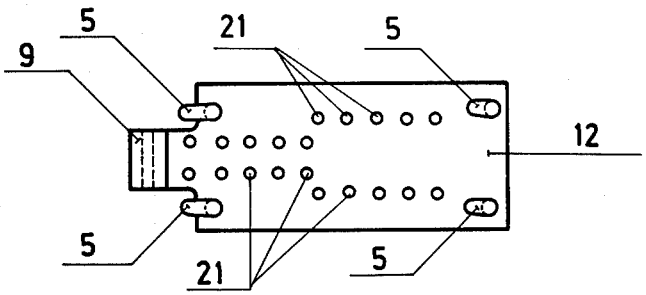
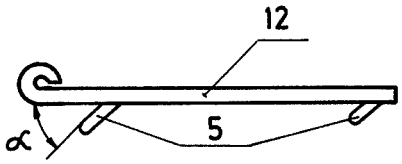
Fig. 4a
Fig. 5
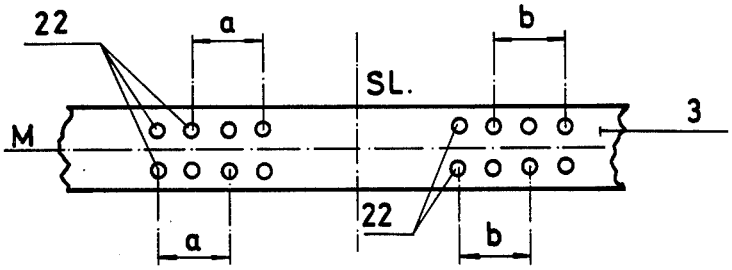
Fig. 6
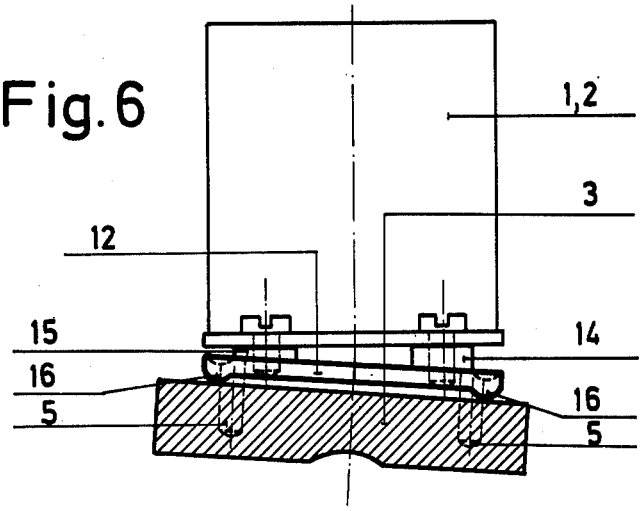

CONNECTING ARRANGEMENT FOR THE DETACHABLE MOUNTING OF A BINDING ON SKIS

The invention relates to a connecting arrangement for the detachable mounting of a binding member consisting of front and rear binding devices on a ski member, which arrangement has connecting elements which are mounted on one of the members and engage in bores which are defined for this purpose in the other member. The binding devices are parts of a binding which are usually mounted on the ski independently of each other.

Most often, screws are used as connecting elements for mounting the ski binding on the ski so that the binding sits on the ski fixedly and is not readily detachable. This mounting of the ski binding is most often done by the sporting goods stores which sell skis. This mounting is relatively complicated and, therefore, expensive since this mounting requires drilling holes in the ski at certain points depending on the binding. Also, the success of the mounting depends greatly on the accuracy of the work so that faults are frequently encountered.

In this type of mounting, a special fitting plug gage and sometimes another special tool are required for each type of binding. In addition, it would not be useful, for example, to buy only one set of bindings for two pairs of skis and to mount them on the skis desired at any one time because the solidity of the screw connection would soon be lost.

Connecting arrangements for the detachable mounting of the binding on skis are also known wherein plates with openings are mounted on the surface of the skis in which connecting elements on the binding or binding parts engage, and these connecting elements are held in the openings. The connecting elements are constructed in the form of flange bolts or angle bars, the bolt extending parallel to the plane of the plate or the surface of the ski or a similarly extending leg of the angle bar engaging below the rim of the respective opening to mount the binding. This results in a complicated construction which requires complex manipulations when the binding is assembled on the ski and when the binding is detached from the ski.

The invention has the object to overcome all these disadvantages and to provide a connecting arrangement for detachably mounting bindings on skis, which is structurally simple and assures a firm seat of the binding on the ski and which can be applied without any expertise and use of tools by a layman quickly and effectively.

The connecting arrangement according to the invention provides connecting studs affixed to one of the members and extending obliquely to the upper surface of the ski member and enclosing therewith an acute angle $\alpha$ substantially less than 90°, which is preferably smaller than 60°, in planes extending perpendicularly to the upper ski member surface and parallel to a longitudinal center line of the ski member when the binding member is mounted thereon. The studs associated with the front binding device extend in one direction and the studs associated with the rear binding device extend in another direction and the studs associated with the front binding device are approximately symmetrically arranged relative to the studs associated with the rear binding device in relation to an imaginary plane of symmetry extending perpendicularly and transversely to the upper ski member surface between the front and rear binding devices. The other member defines bores arranged to receive the connecting studs whereby the studs may be plugged into the bores.

A secure seat is obtained with this arrangement of the invention with a very simple construction. The elasticity of the skis in the center regions also remains practically unchanged by this connecting arrangement. The easy manipulation makes it possible to mount alternatively several different bindings on one and the same ski without any difficulty, or equally to use one and the same binding for several skis. In this manner, anyone may, for example, use a single pair of bindings for downhill ski (tour ski), giant slalom ski and slalom ski. Furthermore, the transportation of many skis (on the car roof) is now substantially facilitated because the binding is packed separately and the skis may be disposed close to each other, which saves much space.

Preferably, the studs associated with the front binding device extend obliquely downwards forwardly and the studs associated with the rear binding device extend obliquely downwards rearwardly, and thus a force is exerted between the heel and the toe effective to bias the two binding parts apart in a direction to press the studs into their receiving bores. In this way, the boots held in the binding will increase the holding force with which the binding is retained on the ski.

It is possible in the connecting arrangement according to the invention to provide the studs in the ski and the corresponding receiving bores for the studs in the binding parts. But to keep the upper surface of the skis completely free of protrusions and to be able to stack the skis tightly when the binding has been removed, it is advantageous to arrange the studs on the binding parts while receiving bores are provided in the ski extending from the upper surface thereof under the same acute angle $\alpha$ in relation to the surface as the studs, the receiving openings having a cross section whereinto the studs fit.

It is particularly advantageous to arrange on the underside of each binding part an intermediate plate which has the studs affixed thereto. The intermediate plates define at least two adjacent rows of bores for selectively receiving fastening elements for mounting the intermediate plate on the binding parts. In this manner, the mounting of the connecting arrangement on the ski is greatly simplified since the production and the positioning of the receiving bores in the ski can be effected largely independently of the size of the boot and the type of the binding because the fitting is made in the region of the connection intermediate plate-binding part. In this manner, the accuracy of the receiving bores may be increased and the work required for its production may be reduced. The binding parts, are connected fixedly with the intermediate plate, for instance by rivets or screws. The rivets or screws are positioned at those points where there are anyhow fixing holes in the front and rear binding devices for screwing onto the ski. A front or rear binding device thus equipped with an intermediate plate may be positioned on any ski having bores into which the studs fit.

The studs provided in the arrangement of the invention are advantageously cylindrical, possibly also somewhat conical, since the receiving bores for such studs may be easily made. For the purpose of accurate manufacture and stability of the intermediate plates, which are provided with studs, it is advantageous to provide flat or cross sectionally polygonal studs, such studs also possibly being manufactured integrally with the intermediate plate.

To obtain a strong connection with the ski, a fixing device is advantageously provided which permits a force to be exerted from the ski or the intermediate plate to the part affixed thereto, by which the studs are pressed into the associated receiving bores in the ski. This fixing device is (manually) operated after the binding part is plugged in and may be a snap connection.

Since the force exerted upon the binding parts by a boot set in the binding operates in the sense of reinforcing the retention of the binding when the free ends of the studs point in opposite directions, the fixing device is required in this case primarily for retaining the binding part before the boot is set in the binding. For this purpose, a tongue may very simply be provided of which one end is affixed to the intermediate plate and whose other end is anchored to the ski.

To improve the seating of the binding part provided with the studs on the ski further and to equalize possible surface unevenness, it is advantageous to provide at least in the region of the studs intermediate layers, for instance of the type of washers or even a whole plate. These possibly elastic intermediate layers which rest on the ski itself may consist of a rubber-like material.

If intermediate plates are provided in the connecting arrangement of the invention, an insert may be provided between the intermediate plates and the associated binding parts; it is thus possible to impart to the ski boot on the ski an inwardly or outwardly canted position and thus to achieve an adaptation to the leg formation of the user (bandy legs or knock knees). To be able to distinguish between the left and the right ski, different arrangements of the studs and the receiving bores may be provided for the right and for the left ski or the corresponding bindings.

Figure 8:
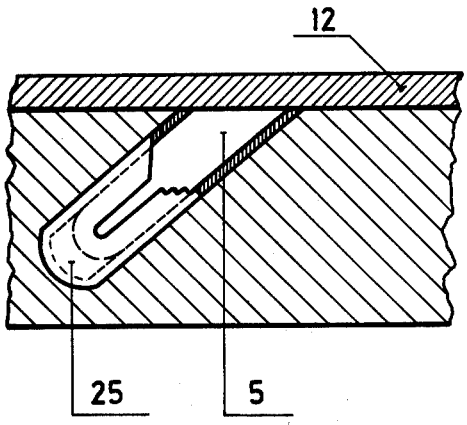
Figure 9:
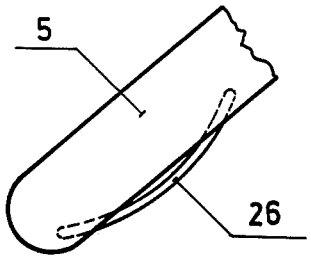

For a better understanding of the invention, it will be further described hereinbelow in connection with embodiments schematically illustrated in the drawings wherein FIG. 1 is a complete ski binding in very simplified form in side elevational view, which is retained on the ski with a connecting arrangement according to the invention, FIG. 2 and 2*a* are a top and bottom view, respectively, of a front ski binding device which is provided with studs, FIGS. 2*b* and 2*c* are like respective views of a rear ski binding device which is provided with studs, FIG. 3 shows an embodiment of a connecting arrangement of the invention provided with an intermediate plate, in transverse cross section FIG. 4 and 4*a* shows an embodiment of such an intermediate plate in top and side view, respectively, FIG. 5 shows an arrangement of the receiving bores for the studs in the ski, which permits an adaptation to various sizes of boots, FIG. 6 shows an embodiment of the connecting arrangement of the invention wherein intermediate layers are inserted for adaptation to different leg positions, FIG. 7 shows a connecting arrangement of the invention in cross section, with a spring fixing device, FIG. 8 illustrates a receiving bore for studs with a resilient sleeve, and FIG. 9 shows a stud with a resilient insert.

In FIG. 1, which is a side elevational view of a ski with binding, the ski being shown in longitudinal section, 1 designates any front binding device, which is schematically shown as a rectangle, and 2 any rear binding device, which is also shown schematically. Both are fixed to a ski designated by 3. The connection to the ski is provided by studs 5 and 5′ which are plugged into the upper surface of the ski under an angle $\alpha$ in corresponding receiving bores in ski 3 and are fixedly connected to binding parts 1,2. The angle $\alpha$ is substantially smaller than 90°. Preferably, it is smaller than 60°. The geometric center lines of the studs are positioned in planes which are perpendicular to upper surface 3*a* of ski 3 and extend parallel to the longitudinal center line of the ski. Studs 5 on front binding device 1 are oriented approximately symmetrically with respect to studs 5′ on rear binding device 2 in relation to an imaginary plane 20 which is perpendicular and transverse to the ski and passes between binding device 1 and binding device 2. In particular, studs 5 are directed obliquely downwards and forwardly and studs 5′ obliquely downwards rearwardly.

For retaining binding device 1 a fixing device is provided additionally, constituted by abutment 6 respectively affixed to the ski and a tensioning member 7 with holder 8. Holder 8, for example a U-shaped wire yoke, is pivoted to binding device 1. A manually operable tensioning member 7 is pivotally mounted on yoke 8. In the illustrated position of tensioning member 7 it is depressed, i.e., it is snapped in and tensions wire yoke 8, whereby binding device 1 is pulled into that direction in which the free ends of studs 5 point. An analogous fixing device (not shown) retains rear binding device 2. A sliding of the binding parts out of their fixed position and of the studs out of their receiving bores is thereby prevented as long as the fixing device is tensioned. Merely by pivoting the tensioning member upwardly, each binding part may, however, be detached instantaneously so that it may be removed. FIG. 1 further illustrates that the ski boot itself also operates in the sense of retaining the binding parts since it tends to prevent a displacement of the binding parts toward each other, respectively biasing them apart.

Departing from the embodiment of the invention illustrated in FIG. 1, a number of advantageous modifications are possible.

Thus, it is possible with the embodiment according to FIG. 3 to retain in a simple manner detachably on the ski any commercially available binding in the manner according to the invention. For this purpose, an intermediate plate 12 is provided which carries studs 5 and which is fixedly connected with the respective binding device, for instance by riveting or threadedly, it being possible to insert for the balancing of the foot position an insert between the intermediate plate and the binding device. Since bores are provided anyhow in each binding device of conventional bindings for affixing them on the ski, they may be used for riveting or threadedly fastening the intermediate plates 12 thereto, and it is necessary only to provide the intermediate plates with holes, which may be threaded at suitable points. For adaptation to different sizes of boots, it is advantageous to provide in intermediate plate 12 fixing holes 21 arranged in rows, as is the case in the embodiment according to FIG. 4. These rows of holes may be used for fastening the ski boot in relation to the center of the ski to a certain degree adjustably forwardly or rearwardly.

On the other hand, if no intermediate plate is provided and studs 5, 5′ are mounted directly on front binding device 1 or rear binding device 2, receiving bores 22 may be arranged in rows directly in the ski for adapting to various boot sizes, as has been shown in FIG. 5. In this regard, the distance between bores 22 of one group in the ski may be selected the same or differently for both skis of a pair; the latter to make a differentation between left and right possible.

As illustrated in FIG. 5, bores 22 may be arranged symmetrically to the center lines M and SL on a respective ski. However, other arrangements are also possible. For instance, deviating from FIG. 5, differing distances between bores 22 may be provided. The arrangement of the bores according to FIG. 5 permits the front and rear binding device to be adjusted by half the distance a and b, respectively, of studs 5, 5'. A larger number of bores permits a finer adjustment.

Modifications in the arrangement of the studs will now be described in connection with FIGS. 2 and 2*a*. In FIGS. 2 and 2*a*, that part on which the studs are mounted, regardless of whether it does or does not include an intermediate plate 12 is simply shown as a rectangle. The rectangle designated by 1 symbolizes a front binding device whose front edge is designated by 10, and the rectangle designated by 2 symbolizes a rear binding device whose front edge is designated by 11. The spacing between studs 5 on the front binding device is designated a and that of studs 5' on the rear binding device is designated b. These spacings may be identical. Studs 5 point obliquely downwardly in the direction of front edge 10 and studs 5' obliquely downwardly away from front edge 11. Instead, as illustrated, of providing always groups of four studs, six studs may be used, for example, to obtain greater stability. Under certain circumstances, a single stud suffices if it is strong enough and is strongly anchored in the ski, and the respective binding device is secured against rotation, which may be achieved also by corresponding oblique positioning of the stud.

It is possible to provide stud 5 and 5', respectively, as an integral component of the ski, particularly if a suitable intermediate plate with opening for receiving these studs has also been provided. The intermediate plate would again be affixable to any binding.

In the example of FIG. 3, a plate 13 is provided on the upper surface of ski 3 as a part thereof and reinforces the receiving bores in the ski in which studs 5 engage. In this example, the fixing device is linked (FIG. 4) to left end 9 of intermediate plate 12 with a yoke 8. The intermediate plate 12 is fixedly connected by rivets or screws with superimposed binding device 1. The fixing device may, of course, take another suitable form and, for example according to FIG. 7, may be constituted by tongue 23 having one end connected to a respective binding part and whose other end is anchored with screw 24 to ski 3 to fix the binding part against displacement in the longitudinal direction of the ski. The manipulation will be facilitated if the tongue is resilient.

The receiving bores for studs 5 are advantageously lined with small tubes which may be of metal. The studs may fit therein. Such tubes 25 may according to FIG. 8 be slotted to obtain a resilient engagement with studs 5.

It is also possible to obtain a resilient emgagement of studs 5 in the receiving bores by providing resilient parts 26 on studs 5 (FIG. 9).

In the interests of a simplified manufacture, flattened studs may be provided since the tolerance requirements in such studs are lower than with cylindrical studs. In this regard, the studs may also have a polygonal cross section. A further simplification of the manufacture is obtained, while maintaining acceptable accuracy, if intermediate plate 12 is made integrally with studs 5 arranged thereon.

In FIG. 6, a ski 3 is shown in cross section which carries intermediate plate 12 with studs 5. Any binding device 1, 2 is screwed to this intermediate plate 12, with inserts 14 and 15. Instead of using two or more inserts 14, 15, a single beveled plate, preferably of synthetic resin, may be used. With this arrangement, wherein the parts 14, 15 may be exchanged, it is possible to take into account individual adjustment. To obtain a secure positioning even if the ski surface is not entirely plane, it is advantageous to provide desired support points, as has been illustrated in FIG. 6 at 16.

When no intermediate plate 1 is present, i.e. the binding part 1 or 2 itself carries studs 5, the desired support points may be provided on binding part 1 or 2 itself. It is also conceivable to use simple washers.

It is obvious from the indicated embodiments that a multiplicity of modifications are conceivable within the framework of the invention and may be advantageous for certain purposes. The described embodiments constitute only a portion of the possibilities.

I claim:

1. A connecting arrangement for detachably mounting a binding member consisting of a front binding device and a rear binding device on a ski member having an upper surface, which comprises (a) connecting studs affixed to one of said members, the studs (1) extending obliquely to the upper surface of the ski member and enclosing therewith an acute angle substantially less than 90° in planes extending perpendicularly to the upper ski member surface and parellel to a longitudinal center line of the ski member when the binding member is mounted thereon, (2) the studs associated with the front binding device extending in one direction and the studs associated with the rear binding device extending in another direction, and (3) the studs associated with the front binding device being arranged substantially symmetrically with respect ot the studs associated with the rear binding device in relation to a plane of symmetry extending perpendicularly and transversely to the upper ski member surface between the front and rear binding devices, and (b) the other one of said members defining bores arranged to receive the connecting studs whereby the studs may be plugged into the bores.

2. The connecting arrangement of claim 1, wherein the angle is smaller than 60°.

3. The connecting arrangement of claim 1, wherein the one direction in which the studs associated with the front binding device extend is downwardly frontward and the other direction in which the studs associated with the rear binding device extend is downwardly rearward.

4. The connecting arrangement of claim 1, whereing at least two of said connecting studs are affixed to the one member associated with each of the binding devices.

5. The connecting arrangement of claim 1, further comprising a resilient part attached along a longitudinal side of each of said studs whereby the studs operate as banana plugs.

6. The connecting arrangement of claim 1, wherein the bores are defined by longitudinally split, resilient tubular walls arranged for slidingly receiving and clamping the studs in the bores.

7. The connecting arrangement of claim 1, wherein the one member is the binding member and the studs are affixed to the front and rear binding devices, and the other member is the ski member, the bores extending fron the upper surface thereof at said acute angle whereby the studs of the binding devices may be plugged into the bores in the ski member.

8. The connecting arrangement of claim 7, wherein the bores extending from the upper ski member surface are arrayed in several groups, each of said groups of bores being arranged to receive the studs of one of the binding devices.

9. The connecting arrangement of claim 8, wherein the same number of groups of bores is provided for the front binding device and for the rear binding device, the groups of bores being equidistantly spaced from each other.

10. The connecting arrangement of claim 7, further comprising an intermediate plate between the upper ski member surface and each one of the binding devices, the studs being affixed to the intermediate plates, and means for mounting the intermediate plates on the binding devices, the mounting means including fastening elements and the intermediate plates defining at least two adjacent rows of bores for selectively receiving the fastening elements.

11. The connecting arrangement of claim 10, wherein the studs are integral with the intermediate plates.

12. The connecting arrangement of claim 10, wherein the intermediate plates are steel sheets of about 3 mm gauge.

13. The connecting arrangement of claim 10, further comprising a fixing device affixed to each intermediate plate, the fixing device including a tensioning member for applying a force to the intermediate plate approximately parallel to the upper surface of the ski when the binding member is mounted thereon and pointing in the direction in which the studs are oriented.

14. The connecting arrangement of claim 13, wherein the tensioning member is a tongue having two ends, one of the tongue ends being affixed to the intermediate plate and the other tongue end carrying an anchoring element attached to the ski when the binding member is mounted thereon.

15. The connecting arrangement of claim 7, further comprising a fixing device respectively attached to a respective one of the binding devices, each fixing device including clamping means for clamping the fixing device to the ski when the binding member is mounted thereon, the clamping means being arranged to exert a pressure force on the respective binding device in the direction in which the studs are oriented.

16. The connecting arrangement of claim 7, further comprising support points projecting between the binding devices and the upper ski member surface.

17. The connecting arrangement of claim 7, further comprising wedge inserts between the binding devices and the upper ski member surface.

18. A ski having an upper surface and two groups of bores defined by the ski and extending from the upper surface thereof, the bores of each group extending obliquely to the upper ski surface and enclosing therewith an acute angle substantially less than 90° in planes extending perpendicuarly to the upper ski surface and parallel to a longitudinal center line of the ski, and the bores of one group being arranged substantially symmetrically with respect to the bores of the other group in relation to a plane of symmetry extending perpendicularly and transversely to the upper ski surface between the two groups, the groups being space apart along the length of the ski.

19. The ski of claim 18, wherein the angle is smaller than 60°.

20. The ski of claim 18, further comprising sleeves inserted in the bores.

21. The ski of claim 20, wherein the sleeves are longtiduinally split, resilient tubular walls.

* * * * *